US011441244B2

(12) United States Patent
Agzikara et al.

(10) Patent No.: US 11,441,244 B2
(45) **Date of Patent: *Sep. 13, 2022**

(54) COMPOSITE STRETCH YARN, PROCESS AND FABRIC

(71) Applicant: SANKO TEKSTIL ISLETMELERI SAN. VE TIC. A.S., Bursa (TR)

(72) Inventors: Seref Agzikara, Inegol (TR); Mustafa Zeyrek, Inegol (TR); Hamit Yenici, Inegol (TR); Mahmut Ozdemir, Inegol (TR); Kenan Loyan, Inegol (TR); Esin Kalfa Kilickan, Inegol (TR)

(73) Assignee: SANKO TEKSTIL ISLETMELERI SAN. VE TIC. A.S., Inego Bursa (TR)

( * ) Notice: Subject to any disclaimer, the term of this patent is extended or adjusted under 35 U.S.C. 154(b) by 349 days.

This patent is subject to a terminal disclaimer.

(21) Appl. No.: 16/298,213

(22) Filed: Mar. 11, 2019

(65) Prior Publication Data

US 2019/0203385 A1 Jul. 4, 2019

Related U.S. Application Data

(63) Continuation of application No. 13/881,534, filed as application No. PCT/EP2011/005723 on Nov. 14, 2011, now Pat. No. 10,260,175.

(30) Foreign Application Priority Data

Nov. 12, 2010 (EP) ..... 10014545

(51) Int. Cl.

| | |
|---|---|
| ***D02G 3/32*** | (2006.01) |
| ***D01H 5/70*** | (2006.01) |
| ***D02G 3/02*** | (2006.01) |

(52) U.S. Cl.
CPC ..... *D02G 3/326* (2013.01); *D01H 5/70* (2013.01); *D02G 3/02* (2013.01); *D02G 3/324* (2013.01);
(Continued)

(58) Field of Classification Search
CPC ..... D02G 3/045; D02G 3/326; D02G 3/328; D02G 3/36; D02G 3/32–346
(Continued)

(56) References Cited

U.S. PATENT DOCUMENTS

| | | | |
|---|---|---|---|
| 3,092,953 | A | 6/1963 | Blackstock |
| 3,385,044 | A | 5/1968 | Anderson et al. |

(Continued)

FOREIGN PATENT DOCUMENTS

| | | | |
|---|---|---|---|
| EP | 1 518 950 | A2 | 3/2005 |
| JP | 2002-146641 | A | 5/2002 |

(Continued)

OTHER PUBLICATIONS

"JP2008297646_Machine Translation" is a machine translation of JP-2008297646-A. (Year: 2008).*

(Continued)

*Primary Examiner* — Larissa Rowe Emrich
(74) *Attorney, Agent, or Firm* — Sughrue Mion, PLLC

(57) ABSTRACT

In a stretch yarn (1) comprising a stretchable core (2) covered by an inelastic fibers sheath (3) the stretchable core (2) comprises first and second fibers (4, 5) that have elastic properties, the first fiber (4) is an elastomer and the second fiber (5) is a polyester based (co)polymer, the amount of the second fiber being in the range of 60-90% (w/w) of the total weight of the fibers of the stretchable core (2); the first and second fibers are connected together at least at a plurality of points (P).

24 Claims, 3 Drawing Sheets

(52) U.S. Cl.
CPC ..... *D02G 3/328* (2013.01); *D10B 2331/04* (2013.01); *Y10T 428/249921* (2015.04); *Y10T 428/2936* (2015.01)

(58) Field of Classification Search
USPC ..... 428/373–377, 392–395
See application file for complete search history.

(56) References Cited

U.S. PATENT DOCUMENTS

| | | | | |
|---|---|---|---|---|
| 2006/0116044 | A1* | 6/2006 | Anand | D04B 21/10 442/306 |
| 2007/0135009 | A1 | 6/2007 | Liao | |
| 2008/0318485 | A1 | 12/2008 | Cheng | |
| 2009/0269582 | A1* | 10/2009 | Hiraishi | D01F 8/04 264/172.15 |
| 2010/0281842 | A1 | 11/2010 | Tharpe et al. | |

FOREIGN PATENT DOCUMENTS

| | | | | |
|---|---|---|---|---|
| JP | 2002-155442 | A | | 5/2002 |
| JP | 2003-119632 | A | | 4/2003 |
| JP | 2003-171838 | A | | 6/2003 |
| JP | 2003-247131 | A | | 9/2003 |
| JP | 2006-225798 | A | | 8/2006 |
| JP | 2008-297646 | A | | 12/2008 |
| JP | 2008297646 | A | * | 12/2008 |
| JP | 2010-203016 | A | | 9/2010 |
| WO | 2008/130563 | A1 | | 10/2008 |
| WO | 2009/141469 | A1 | | 11/2009 |

OTHER PUBLICATIONS

Written Opinion from Japanese Patent Office in Application No. 2019-700138, dated Sep. 13, 2019.
Notification of Reasons for Refusal dated Dec. 17, 2019 from the Japanese Patent Office Application No. 2019-700138.
"Handbook of Fiber" the second edition, Society of Fiber Science and Technology, Japan, Maruzen Co., Ltd., Feb. 15, 1995, p. 279 (5 pages total).
Machine Translation of JP 2008-297646 (Year: 2008).
Machine Translation of JP 2009-171838 (Year: 2009).
Notice of Reasons for Revocation dated Dec. 20, 2017, issued by the Japanese Patent Office in corresponding Japanese application No. 2013-538108 (JP patent No. 6121332).
Statement of Opposition of Patent dated Oct. 24, 2017, to Japanese Patent Office for corresponding Japanese application No. 2013-538108 (JP patent No. 6121332).

* cited by examiner

COMPOSITE STRETCH YARN, PROCESS AND FABRIC

CROSS REFERENCE TO RELATED APPLICATIONS

This application is a Continuation of U.S. application Ser. No. 13/881,534 filed Jun. 4, 2013, which is a National Stage of International Application No. PCT/EP2011/005723 filed Nov. 14, 2011, claiming priority based on European Patent Application No. 10 014 545.7 filed Nov. 12, 2010, the contents of all of which are incorporated herein by reference in their entirety.

FIELD OF THE INVENTION

The present invention relates to a composite stretch yarn and the stretch woven fabric comprising such yarn. The invention also relates to an apparatus and a method of producing said stretch yarn.

BACKGROUND OF THE INVENTION

More specifically, this invention relates to a stretch yarn having a composite core and a cotton fibres sheath; a preferred stretch fabric is denim.

There are several ways to make stretch fabrics in woven textile industry; mono stretch fabrics include elastic yarns only in warp or weft direction, in bi-stretch fabrics both in warp and weft directions elastic yarns are used.

The most common way of producing stretch fabric is weft (filling) stretch fabrics. Weft stretch fabrics have non elastic warp yarns and elastic weft yarns. In these fabrics different kind of elastic weft yarns such as corespun elasthane yarns, twisted elasthane yarns, intermingled or twisted synthetic elasthane yarns etc. are used. Elastic yarns are well known; the earlier fabrics, such as in U.S. Pat. No. 3,730,679 comprised stretch yarns that contained one elastomeric fiber and cotton fibers. These yarns provided fabrics with low recover after stretching: a typical elongation of these fabrics is of 15 to 40% in the weft direction, but the recovery characteristics are very low, usually as low as about 90% (ASTM D3107), i.e. the fabric has a growth of about 10%.

To solve this problem, woven stretch fabrics comprising polyester bicomponent fibers have been disclosed, for example in U.S. Pat. Nos. 5,922,433 and 6,782,923. The fabrics disclosed in these references are comprised of bare bicomponent fibers and have strong synthetic appearance and hand due to the exposure of the bicomponent fibers on the fabric surface.

There is another way to make stretch fabric without using elasthane, in this type of fabrics usually elastic type of synthetic yarns are used like PBT, PTT or T400, i.e. a bicomponent PTT/PET.

Stretch denim fabrics made from a bi-component polyester and cotton are described in U.S. Pat. Nos. 7,310,932 and 5,874,372. However, fabrics made from elastic polyester lack good elasticity.

US 20080268734 discloses an elastic composite yarn comprising a core bi-component fiber in a cotton fibers sheath; the core comprises an elastic fiber and an inelastic fiber loosely wound around the elastic one. The purpose of the inelastic fiber is to improve the recovery properties of the yarn, so as to increase the recovery properties of the fabric including the above mentioned yarns. Drawbacks of this embodiment are that the inelastic fiber of the core is also acting as a block to the stretch of the elastic fiber and that the bundle of inelastic fibers appears through the cotton sheath in the final fabric.

The surfacing of the elastic core in the inelastic fibers sheath also occurs in other types of stretch yarns.

Therefore, there is the need to improve the known techniques and to provide a stretch yarn that can provide stretch fabrics with reduced fabric growth and still having a good stretch performance.

SUMMARY OF THE INVENTION

It is an aim of the present invention to solve the above problems and provide yarns and fabrics having great elasticity and excellent stretch recovery.

A further aim is to provide a stretch yarn that is completely covered by the fibres sheath, preferably a cotton fibres sheath, without the core surfacing through the fibres, especially after use.

Such an aim is obtained by means of the yarn according to claim 1. According to the invention the yarn has a stretch core comprising at least two fibers, or bundle of fibers, having elastic properties and wherein at least one has excellent recovery properties.

A further object of the invention is a fabric, particularly a denim fabric, containing a stretch yarn as above defined.

The invention also relates to a method of producing a stretch yarn according to claim 9, said method comprising: providing a stretchable core comprised of first and second fibers that have elastic properties, said fibers being connected together in at least a plurality of points; wherein said first fiber is an elastomer and said second fiber is a polyester based (co)polymer, said second fiber being in the range of 60-90% (w/w) of the stretchable core; tensioning said fibers and providing a sheath of inelastic fibers to completely cover said core.

With the wording "first fiber" or "second fiber" of the core it is meant a bundle of fibers, such as in elasthane and in T400 elastic fibers; with the wording elastic properties it is meant that in the fibers some elasticity is always present and that in some preferred embodiments further elasticity can be developed with a thermal treatment.

Another object of the invention is an apparatus for producing a yarn as defined according to claim 13.

This apparatus comprises means for housing at least a cotton roving and a composite core bobbin for each spool and spindle, and further comprises tensioning rollers to draft the composite core yarn before feeding it together with the cotton staple fibers to a spindle or equivalent device.

Further objects of the invention are a fabric including the invention yarn and a garment that contains the above mentioned fabric. Another object of the invention is a stretch yarn according to claim 17.

According to an aspect of the invention, the second fiber is a bi-component polyester fiber, preferably a PTT/PET fiber.

The two fibers, or bundles of filaments, must be connected, i.e. bound, together to provide a final elastic "core yarn" that combines the technical characteristics of the two, or more, bundles of filaments. More particularly, the first fiber, that is an elastomer, has very good elastic and stretch properties, while the second fiber is a polyester based fiber having excellent recovery properties.

In general, the first elastic fiber can be stretched at least 400% and the second fiber is less elastic but can be stretched at least 20%; an important property of the second fiber is its recovery property, at least 90%, preferably 93%, most preferably at least 96% or 97% or higher of the fiber.

Concerning the connection of the two fibers, this should be carried out at least at a plurality of points.

According to a preferred aspect of the invention, the first and second fibers are connected together by intermingling or co-extrusion or by twisting. Especially when the second fiber, too, is made of two different polymers, e.g. it is an elastomultiester such as PTT/PET and similar filaments, such as those disclosed in EP 1846602, coextrusion of the three polymers appears to be an advantageous production process.

Intermingling is carried out according to the known techniques of the art, such as open or closed intermingling jets. The system is arranged to provide a number of connecting points that is within the range of 50 to 200 points per meter, preferably 80 to 120 points per meter and most preferably 95 to 105. The method of measuring the number of intermingling point is by direct count of the combined fibers; in the latter method, the elastic core "yarn" is put on a black or dark surface and is inspected by eye, possibly with a magnifying glass, and the connecting points in a meter of yarn are manually counted.

As recited in claim 1, in an exemplary embodiment the core fibers of the invention yarn are connected to each other by twisting. This means that twisting is not carried out loosely (i.e. with about 75-125 twist per meter, as in above quoted prior art US'734) but that the number of twists per meter is sufficiently high to provide a connection between the fibers.

For twisting of a bicomponent fiber and elasthane a preferred range is 300-600 twist/meter, preferably 350-550, in general at least 400 and most preferably 450-525 twist per meter.

In a preferred embodiment, before connecting the first and the second core fibers at least the first, elastic, fiber is stretched, so that after interconnection the released fiber will recover and reduce its length. This will result in an amount, or in a length, of the second fiber being available for stretching of the the core, multicomponent, yarn; the composite yarn can be significantly stretched even if one of the two fibers (so called second fiber) is less or much less elastic than the other, first, fiber. Preferably, the first elastic fiber is stretched with a draft ratio of 2.5 to 4.2, more preferably 3.0 to 4.0 times and most preferably about 3.5. It should be noticed that in the exemplary embodiment the interconnected first and second fibers of the core of the invention yarn act substantially as a single fiber, contrary to what happens in prior art embodiments. The high recovery properties of the second fiber will result in the invention yarn, and, more particularly, in the final fabric, being at the same time stretchable and with excellent recovery. Preferred interconnection is by fibers intermingling.

The non elastic sheath or cover is made of non elastic fibers, namely staple fibres and preferably the fibers are cotton fibers.

The amount of the second fiber in the composite elastic core of the yarn, i.e. the sum of all elastic fibers, is 60% to 90% by weight, preferably 73% to 87% by weight on the total weight of the core fibers.

According to the invention, the composite elastic core is stretched before being spun with the staple fibers, the draft ratio of the composite core is within the range of 1.05 to 1.16 and preferably from 1.12 to 1.14. The draft or stretch ratio is generated by the difference of the speed of the rollers that feed the composite core fibers to the spinning device and is calculated as the ratio of the speed of the faster roller and the speed of slower roller (faster/slower); the speed is that of a point on the cylindrical surface of the roller. When the composite core is drafted in the preferred range of 1.12 to 1.14 the resulting yarn is totally free from surfacing of the core through the staple fibers and the yarn can provide a final fabric having an even color effect and a hand that cannot be distinguished from a corresponding fabric free from stretchable yarns.

The amount of elastic core (elastic fiber and polyester based fiber (mono or bi-component) in the yarn is depending on the English cotton count (NE) of the yarn and depending on the title, e.g. the deniers, of the core fibres; in a preferred embodiment, the yarn NE count is within the range of 5 to 25 and the amount of core fibers is from 8 to 35% (w/w) on the total weight of the yarn, preferably 8 to 30%. Possible combinations of the two fibers are, in the case of Huvis, or T400, and elasthane (Lycra), the following ones (in deniers) 70/40; 70/70; 50/40; 50/20; 30/40; 30/20; 70/20; 50/70; 30/70, the first value refers to the denier of Huvis or T400 and the second one to denier of elasthane. The range of the amount of core fibres can be as low as 3.5-23.6% (w/w) in the case of the combination 30/20, where the NE is in the range 6-40 and the draft ratio is 1.14. A combination 70/70 will provide useful yarns with a draft ratio of 1.14, NE of 6-20 and an amount of core fibers within the range of 8.9 to 29.7.

BRIEF DESCRIPTION OF THE FIGURES

The invention will now be further disclosed in greater detail with reference to the drawings enclosed for non-limiting purposes, in which.

DESCRIPTION OF AN EXEMPLARY EMBODIMENT

In the present description, the term "w/w" means (as is known in the art) weight on weight, e.g. as in the amount in weight of first fiber with respect to the total weight of the core fibers of the invention yarn. The word "(co)polymer" means "polymer or copolymer".

Figure 1A:
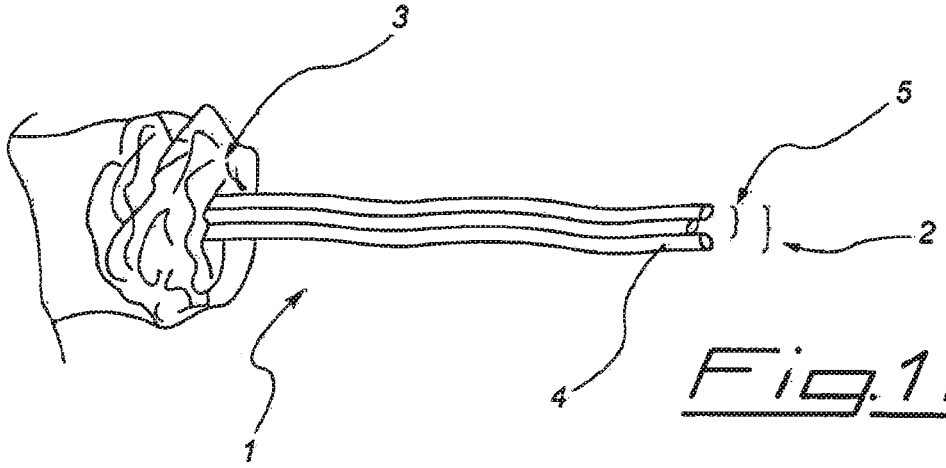
FIG. 1*a* and FIG. 1*b* are a schematic view of a stretch yarn according to the invention.
Figure 1B:
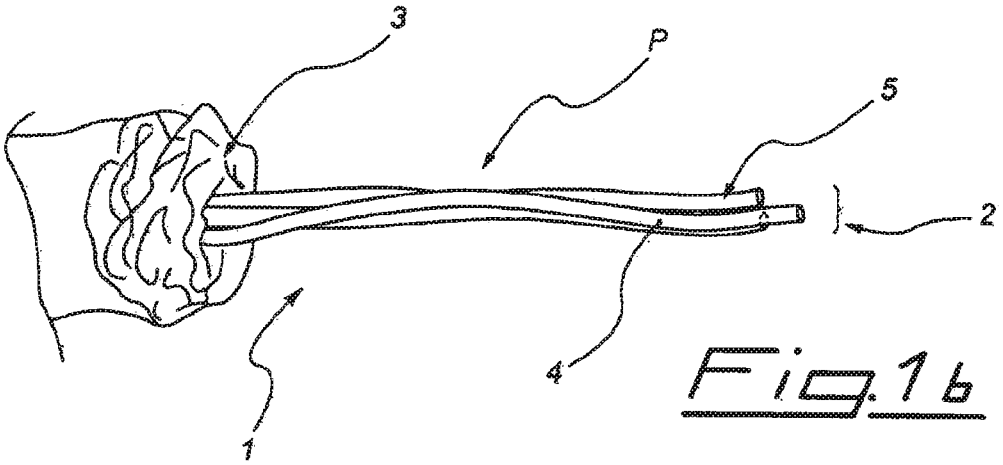

With reference first to FIG. 1*a* and FIG. 1*b*, the stretch yarn 1 of the invention comprises a stretchable core 2 and an inelastic fibers sheath 3 that covers the stretchable core 2; the stretchable core 2 comprises first and second fibers 4, 5, more precisely bundles of filaments, that have elastic properties, more particularly, first fiber 4 is an elastomer known in the art and second fiber 5 is a polyester based (co) polymer, known in the art. First and second fibers are connected to each other or secured together at least at a plurality of points P. Preferably, one of the fibers is more elastic than the other and the other fiber has greater recovery than the first one.

FIG. 1*a* refers to an embodiment in which the fibers are coextruded and FIG. 1*b* to an embodiment in which the fibers are intermingled; the co-extruded fibers are connected substantially continuously and the intermingled fibers at connected at a plurality of points P.

Suitable materials for the first fiber 4 are polyurethanic fibers such as elasthane, spandex and those fibers that have similar elastic properties and in general fibers that can stretch at least for 400% of their initial length (e.g. as elongation at break). Further examples of elastomeric fibers used in the invention include but are not limited to, Dowxla, Dorlastan (Bayer, Germany), Lycra (Dupont, USA), Clerrspan (Globe Mfg. Co., USA), Glospan (Globe Mfg. Co., USA), Spandaven (Gomelast C.A, Venezuela), Rocia (Asahi Chemical Ind., Japan), Fujibo Spandex (Fuji Spinning, Japan), Kanebo LooBell 15 (Kanebo Ltd., Japan), Spantel (Kuraray, Japan), Mobilon (Nisshinbo Industries), Opelon (Toray-DuPont Co. Ltd.), Espa (Toyoba Co.), Acelan (Teakwang Industries), Texlon (Tongkook Synthetic), Toplon (Hyosung), Yantai (Yantai Spandex), Linel, Linetex (Fillatice SpA). More generally, these fibers have very good elastic properties and are highly stretchable. Polyolefin fibers could also be used.

The second fiber 5 is a fiber with limited elasticity level (less than the first fiber but at least 20%) but high recovery properties (more than the first one); as previously mentioned, said second fiber amount with respect to the total core combination of fibers, is in the range of 60-90% (w/w) of the weight of stretchable core fibers.

Suitable materials are polyesters and elastomultiesters such as PBT and the bicomponent polyesters PTT/PET and similar disclosed e.g. in EP 1846602.

Preferably, as shown in FIGS. 1*a* and 1*b*, second fiber 5 is a PTT/PET bicomponent elastomultiester, such as the products commercially available from Huvis e.g. as Zentra, or as T400 from Invista.

Suitable fibers for the sheath 3 are fibers such as cotton, wool, polyester, rayon nylon and similar, preferably cotton staple fibers, to provide a natural look and a natural hand to the elastic yarn; as previously mentioned, the sheath 3 is provided in such a way as to completely cover the stretch core 2. To this end, any suitable process is used to cover the core 2 with the cotton fibers 3; a preferred process is ring spinning.

The amount of cotton in the final yarn (core+sheath) typically is within the range of 60-95%, preferably 70-92% (w/w), according to the deniers of the core 2. The amount of twist per inch is also depending on the features of the yarn; generally, for the yarns according to the present invention, in the formula $T/inch=\alpha\sqrt{NE}$, where T/inch is the number of twist per inch, $\alpha$ is the twist multiple and NE is the English cotton count; the value of $\alpha$ is within the range of 4.0 to 5.0, preferably of 4.4 to 4.6, most preferably 4.5.

As will be better explained hereinafter, the multicomponent core 2 is stretched with a draft ratio of at least 1.05, preferably of at least 1.1 and most preferably of 1.14 prior to being spun with the fibres to provide sheath 3. The tensioning step results in a perfect centering of the core in the sheath and in the possibility of having better cotton coverage of core "yarn" in the final yarn (core+cotton cover/sheath); the yarn thus obtained as well as the fabrics produced with said yarn, have a look and a feel that cannot be distinguished from a yarn or a fabric not provided with the stretch core while at the same time being provided with excellent elastic and recovery properties.

Tests carried out on fabrics made with the stretch yarns according to the invention and corresponding fabrics made with stretch yarns comprising only elasthane as core fiber show that the recovery of the invention fabric is at least 50% higher than the recovery of the control fabric. Recovery improvement can be up to 100%.

It is believed that this excellent result is due to the combination of three elements together to achieve the best performance. The invention combined a fiber (possibly composite) with very high recovery performance elastic yarn but with weak elasticity level (such as Zentra or T400—PET/PTT) together with an elastic fibre, such as elasthane (lycra, dorlastan etc.), with great elasticity levels.

The two fibers are attached together with intermingling, twisting or co-extrusion technology and this combined core yarn has been put inside of the cotton sheath. In this way a yarn that has the best elasticity, the best recovery and with excellent cotton touch was obtained.

Twisting can be carried out in a way known in the art, such as e.g. by Ring twisting or Hamel or 2for1; intermingling is carried out, according to the known art or according to the following method.

A T-400 yarn package is loaded on the creel (not shown). The T-400 yam is guided to a feeding roller and wound around the roller five times. An elastomer, e.g. Elastane yam package is loaded on draft rollers to be provided a draft, and the Elastane yarn is guided through a sensor and combined with T-400 yam at a feeding roller. From the feeding roller the combined fibers are guided to an Intermingling Air Jet 18, e.g. a Sincro Jet intermingling device from Fadis, Italy.

Figure 2:
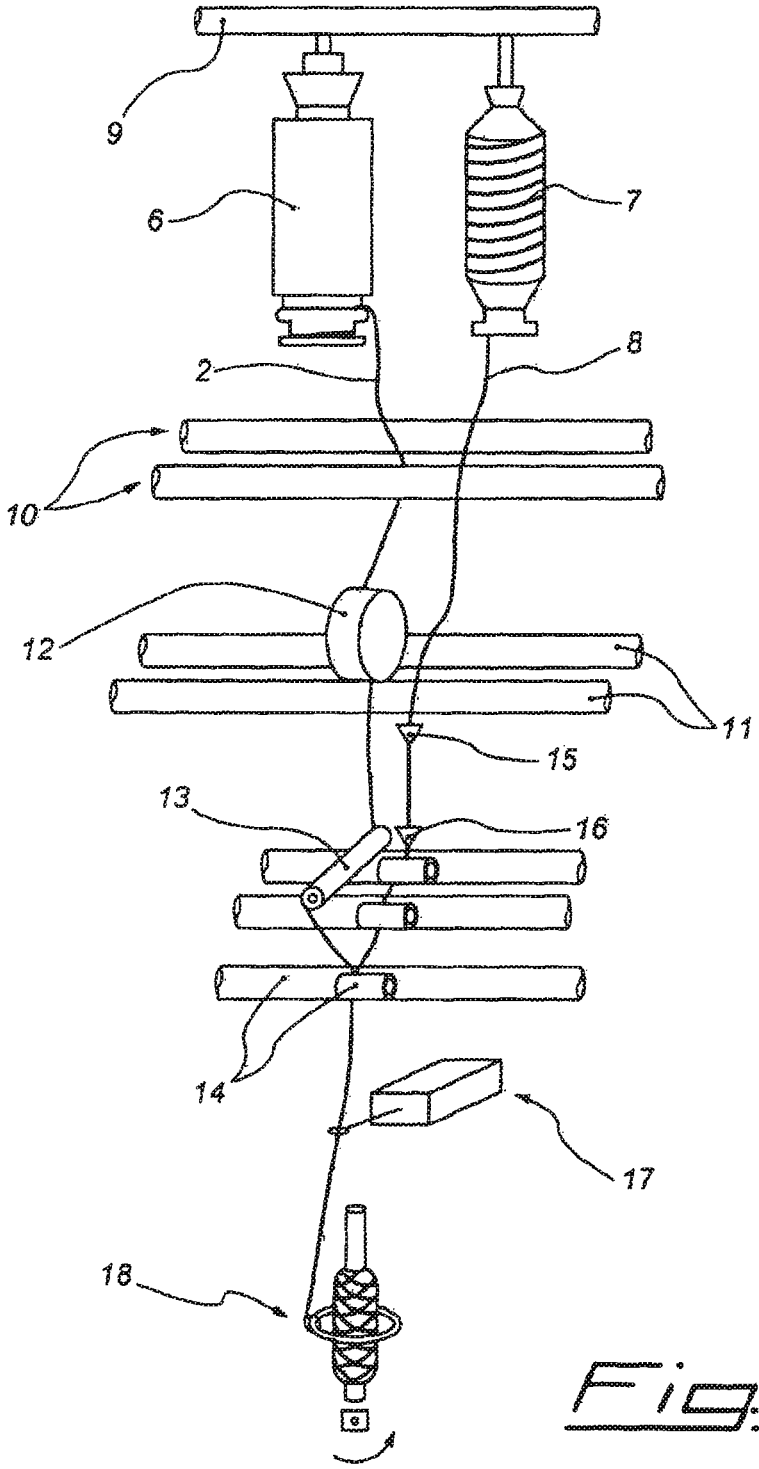
FIG. 2 is a schematic front view of an apparatus suitable for the production of a composite core stretch fiber.
Figure 3:
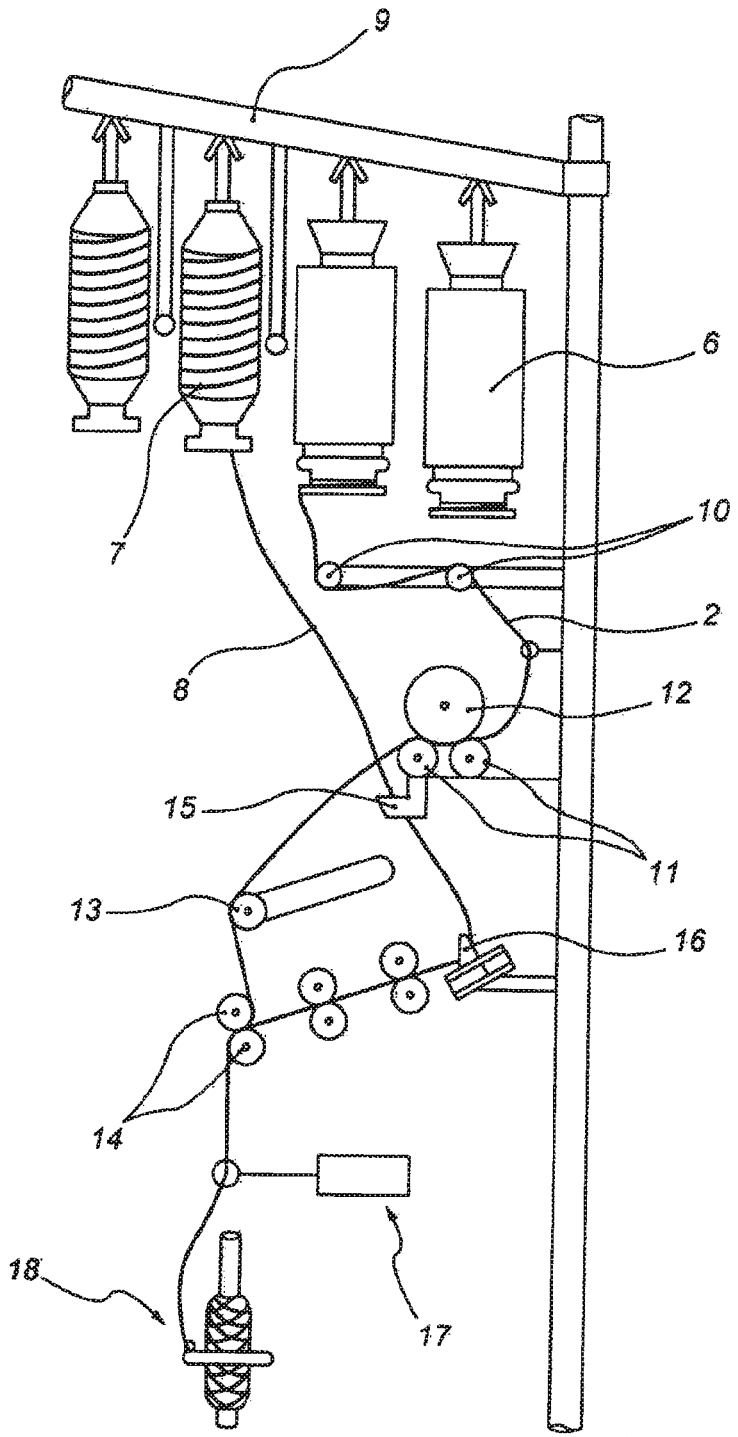
FIG. 3 is a side view of an apparatus for the production of the stretch yarn of the invention.

Subsequently, the intermingled fibers are guided to a lubricating station and are eventually wound on composite yarn package 6 that is shown in FIGS. 2 and 3 after having being mounted in the invention apparatus. The system is arranged to provide a number of connecting points that is within the range of 50 to 200 points per meter, preferably 80 to 120 points per meter and most preferably 95 to 105.

FIGS. 2 and 3 show a preferred embodiment for the production of a yarn according to the invention.

In a typical composite core 2 as above disclosed, comprised of T400 and elasthane, the T400 fibers have 75 Denier and elasthane fibers have 40 or 70 Denier. The yarn count of this composite core is 81.5 or 90 denier which is 2.25-7 times thicker than regular corespun elasthane yarns.

Due to the dimensions of a T400+Elasthane composite core 2, the relevant bobbin is much bigger than a bobbin of elasthane; therefore, as shown in FIGS. 2 and 3, bobbin 6 of core 2 is located on a frame 9 close to cotton roving spool 7.

T400+Elasthane composite core "yarn" 2 is guided between two tension bars 10 that are used to give a low pre-tension to the yarn, just to align and straighten yarn 2. This is very useful in view of the nature of composite core "yarn" 2, especially when the composite yarn is obtained by intermingling of two fibers, namely T400 and elasthane. From pre-tension bars 10, composite core 2 is fed to two driving rollers 11 on which a weight 12 is placed; core 2 is guided between the driving rollers and the weight 12 to avoid free movement of the core yarn with respect to the rollers 11, however, other suitable means for imparting a controlled speed to the core yarn 2 may be used instead of the combination of rollers 11 and weight 12, e.g. means such as draft rollers known in the art.

The advantage of the above disclosed arrangement is mainly in the fact that the same apparatus can be used also to prepare a standard elasthane core yarn: in this case the elastane fibre is loaded in a package that is placed on the rollers 11 in the place of weight 12.

From the first drafting arrangement 11, 12, core yarn 2 is guided to a rolling guide 13 and from it to draft rollers 14, that are the foremost couple of a plurality of drafting rollers for the cotton roving 8, known per se in the art. Cotton roving 8 is guided from spool 7 in front of pre-tension rollers 10, tension rollers 11, into a first guide 15 and a second guide 16; as can be seen in FIG. 3, guide 15 is staggered to the front of the apparatus with respect to second guide 16 in order to create a tension in the roving and keep the roving in a fixed position, avoiding that the roving moves freely.

From guide 16, cotton roving 8 is sent to draft rollers 17, 18 and 14. Draft rollers 14 are in common between core yarn 2 and roving 8.

According to the invention, core yarn 2 is tensioned before being coupled with the cotton roving, the tensioning or stretching is obtained by means of the speed difference between rollers 11 and rollers 14, i.e. the speed difference between rollers 11 and the last draft roller 14 create the draft ratio in composite core "yarn". As mentioned, the draft ratio of the composite core is within the range of 1.05 to 1.16, preferably in the range of 1.10 to 1.14 and most preferably from 1.12 to 1.14.

The above draft ratio is calculated as the ratio of the speed of rollers 14 vs. the speed of rollers 11, where the speed is the angular speed on the surface of the rollers.

It should be noticed that also pre-tensioning bars 10, contribute to obtaining the required draft ratio. The additional pretension bars 10 are useful in increasing the draft ratio from 1.05 to 1.14 because they provide an alignment and slight tension of the composite yarn 2, thus helping in the further stretch step. This results in the extreme accuracy with which the composite core "yarn" 2 is kept in the center of the final yarn 1.

Use of additional guide 15 and its staggered position with respect of guide 16 also allow to feed the cotton roving always at the same position and to prevent the moving of cotton roving during the long run production. The combination of a better control in keeping the position of cotton roving 8 and a high tension on composite yarn 2 makes it possible to keep core 2 always in the center of the final yarn 1 and to perfectly cover the core with the staple fibers 3.

The two portions of final yarn 1 leaving draft rollers 14 are fed through guide 17 and spun together at spinning device 18, known per se in the art and comprising in one embodiment ring, traveler and spindle.

Any spinning method to produce a yarn 1 having a core 2 centered in a sheath 3 is within the scope of the present invention. Such methods include e.g. covered yarn system (using machinery by JCBT, Menegato, OMM, RATTI, RPR, Jschikawa) or twisting machines (using machinery by Hamel, 2for1 by Volkman, SiroSpin by COGNETEX or Zinser).

The elastic yarn produced as big weft packages as above described with reference to FIGS. 2 and 3 can be used in production of elastic denim fabric and garments, especially as weft yarn. Machinery and methods of producing denim are well known in the art, as an example, Morrison Textile Machinery or Sulzer Machinery or modifications thereof maybe used to produce a denim fabric with great elasticity and excellent stretch recovery.

The obtained fabric is then treated with finishing processes, e.g. additional processes can be carried out such as a thermal treatment of the stretched fabric to set the required stretch value for the fabric itself. These treatment are known in art and are carried out in function of the final characteristics required for the fabric.

The invention will now be further disclosed with reference to the enclosed non limiting examples.

Example 1

Yarn Count Test

ZWEIGLE L 232 (Zweigle, Germany)

120 yards of yarn is wound to hank form using a Zweigle device. The hank was weighted using a Metier PM600 (Metier, Switzerland) weight scale. The yarn count was calculated using dtex count system chart. This test was repeated 5 times for consistency and accuracy.

Example 2

Yarn Evenness Test

USTER TESTER-4 (Uster, Switzerland)

Yarn package was set on the creel of the Uster tester-4.

The following parameters were set:

Yarn name was entered

"Yarn" was selected as the setting for material class

Yarn count was entered

"Uster statistic section can not be accepted" has been selected

"Cotton" was entered as the setting for Raw material

The value of Fibre micronare was entered

UT 4-S section, Numbers of packages was set as "5"; number of tests was set as "1"; test speed was set as "400 m/min"; testing time was set as "0.5"; measurement slot was set as "automatic"; sucker was set as "60%"; test mode was set as "normal"; diagram resolution was set as "standard"

Example 3

Strength, Elasticity and Breaking Force Measurement

USTER TENSORAPID-3 DEVICE (Uster, Switzerland).

Yarn was placed on the creel of the Uster tensorapid-3 device.

Yarn was passed through the spring guide.

The parameters entered in the program were:

"Synthetic yarn" option was selected

Measured yarn count (Example 1) was entered as Dtex yarn count system

Number of the test was set to "50"

Testing speed was adjusted to "2000 m/min"

Clamp pressure was set to "30%"

Suct-off pressure in the device was set to "50%"

Blowing jets was set to "off" position

Yarn change was set to "IX" position

Yarn tensioner was set to "out" position

Type of measure was set to "test automatic" position

Example 4

Corespun Cotton+T-400

150 Denier T-400 (Invista) as core yarn and cotton as sheath was Core Spun in yarn mill Rieter Type G30 (Rieter, Germany) equipped with Amsler core spinning device (STG4000. Amsler, Switzerland). T-400 yarns were rewinded from big cylindrical cheese packages to smaller cheese packages. The T-400 yarn was directly fed to the center of the cotton drafting area. Draft ratio was set to "1.1" The English Yarn count (hereinafter "Ne") 10/1 yarn was spun. The yarn twist was set to "TM 4.2". The yarn spools were wound in Savio Orion packaging machine as a weft packages.

See Table 1 for the result of measured strength, elasticity and breaking force; yarn count test; and yarn evenness test as described in EXAMPLES 1, 2, 3.

Example 5

Corespun Cotton+ELASTANE

70 Denier ELASTANE (Lycra, Invista) as core yarn and cotton as sheath was Core Spun in yarn mill Rieter Type 30 (Rieter, Germany) equipped with core spinning device. ELASTANE is supplied in packages that can be loaded directly to corespinning frames.

Draft ratio was set to "3.67"; Ne "12/1" yarn was spun; the yarn twist was set to TM "4.5"; the yarn spools were wound in Savio Orion packaging machine as a weft packages.

See Table 1 for the result of measured strength, elasticity and breaking force; yarn count test; and yarn evenness test as described in EXAMPLES 1, 2, 3

Example 6

T-400+ELASTANE

Preparation of the Core Yarn:

70 Denier T-400 Invista yarn was intermingled with 40 Denier ELASTANE yarn using a intermingling machinery (Sincro Jet, Fadis, Italy).

Counting the number of the intermingling points: 1 meter of yarn was placed on a black cloth; the intermingled points were counted by eye. The test was repeated 5 times and average number was defined as the intermingled points per meter.

The draft ratio of ELASTANE was set to "3.5"

Average 110 intermingling points were used in every 1 meter.

The core yarn (T400+ELASTANE composite yarn) is wound to a package that can be loaded on the creel in the back side of the ring spinning frame The new yarn count was 77 Denier.

Example 7

Cotton+T-400+ELASTANE

Production of the core spinning cotton yarn with the core yarn T-400+ELASTANE is as described in EXAMPLES 4 and 5. The new composite T-400+ELASTANE yarn was fed into core of the cotton yarn.

Draft ratio was set to "1.14"; Ne "12/1" yarn was spun; the yarn twist was set to TM "4.5" ($\alpha$);

The yarn spools were wound in Savio Orion packaging machine as a weft packages.

See Table 1 for the result of measured strength, elasticity and breaking force; yarn count test; and yarn evenness test as described in EXAMPLES 1, 2, 3. From Table 1 it is apparent that, as far as elasticity is concerned, the invention yarn according to example 7 is comparable with the cotton/elasthane-only yarn and is better than the cotton/T400-only yarn; other parameters such as resistance (RKM), break force, tick places etc. of the three yarns are comparable.

Example 8

Weft Stretch Fabrics from cotton+T400

Weft Stretch Denim was prepared using corespun cotton+T400 yarn prepared as described in EXAMPLE 4; Weaving specification:

Warp Yarn: Ne 7.4/1 Ring slub yarn dyed with indigo

Warp Density in reed: 21

Reed Width: 194 cm

Weaving Loom: Sulzer Double width Projectile

Weft Yarn: Ne 10/1 Corespun cotton+T400 (EXAMPLE 4)

Weft Density: 20

Weave: 3/1 RHT

Finishing: Singeing, hot washing with caustic soda (reduce the fabric with), Padding in finishing pad (lubricant, sewing agent and hand builder), and Sanforizing Example 9

Weft Stretch Fabrics from Cotton+ELASTANE

Weft Stretch Denim was prepared using corespun cotton+ELASTANE yarn prepared as described in EXAMPLE 2; weaving specification:

Warp Yarn: Ne 9/1 Ring Slub yarn dyed with indigo

Warp Density in reed: 24.4

Reed Width: 194 cm

Weaving Loom: Sulzer Double width Projectile

Weft Yarn: Ne 12/1 Corespun cotton-ELASTANE (EXAMPLE 5)

Weft Density (Finished fabric): 19.5

Weave: 3/1 RHT

Finishing: Singeing, hat washing (reduce the fabric with), Padding in finishing pad (lubricant, sewing agent and hand builder), Thermofixation in stenter frame (190 C in 43 seconds in width 158 cm), Sanforizing Example 10

Weft Stretch Fabrics from Cotton+T-400+ELASTANE

Weft stretch Denim was prepared using corespun cotton+T-400+ELASTANE yarn prepared as described in EXAMPLE 3; Weaving specification:

Warp Yarn: Ne 9/1 Ring slub yarn dyed with indigo

Warp Density in reed: 24.4

Reed Width: 194 cm

Weaving Loom: Sulzer Double width Projectile

Weft Yarn: Ne 12/1 Corespun cotton+T400+Lycra (EXAMPLE 7)

Weft Density: 19.5

Weave: 3/1 RHT

Finishing: Singeing, hot washing (reduce the fabric with), Padding in finishing pad (lubricant, sewing agent and hand builder), Thermofixation in stenter frame (185 C in 30 seconds in 158 cm width), Sanforizing Example 11

Testing

Denim fabric test samples were prepared from fabrics produced in EXAMPLES 8, 9, and 10. Stretch and Recovery Tests were conducted according to ASTM D3107.

Sample Preparation

Fabrics were washed in Wascator (Electrolux, Sweden) washing machine according to BS 6330 2A at 60 C and subsequently dried in Miele hometype dryer (Miele, Germany). This wash and dry process were repeated 3 times. After the third drying, the fabrics were conditioned (4 hours in conditioned lab 65% humidity, 20±2 C.° hereinafter "conditioned"). After conditioning these fabrics were cut and prepared for stretch and recovery tests. Three rectangular section 60 mm×455 mm (wherein 455 mm was the direction of stretch, hereafter "stretch side") of each fabric was cut. The 60 mm side of each sample was raveled to exactly 50.5 mm. Each sample was folded 32 mm from one end a seam was stitched 25 mm from the fold. A 10 mm slit in the center of the strip on the fold was created. The sample was left for 30 minutes on a flat surface. A mark at center of the sample (250 mm) was made with a ruler.

Testing Procedures

The end of the sample in the top clamp of the stretch testing instrument was clamped so that the looped end hangs free. The marking distance was measured and recorded "A".

A dowel pin was inserted through the loop. A 1360 gr weight was hooked through the slit. The sample was slowly pre-stressed by cycling 3 times from zero to full load back to zero load taking about 5 seconds per cycle and making sure the load stays down for three seconds. After the third cycle the load was applied and the sample was extended for 30 minutes. After 30 minutes the distance between the benchmarks with the weight on the dowel was measured "B". After measurement the weight was released and the sample unclamped from the board and laid flat on the table. The sample was relaxed for 60 minutes and the distance between the benchmarks was measured "C".

Calculation

Fabric stretch was calculated according to following formula:

$$\% \text{ stretch}=100\times(B-A)/A$$

Fabric growth was measured at different time intervals according to the following formula:

$$\% \text{ growth}=100\times(C-A)/A$$

Table 2 test results show that the stretch of the invention fabric is comparable with the stretch of the more elastic fabric containing the cotton/elasthane only yarn. The stretch of the fabric obtained from the T400-based yarn is comparable with the stretch of a standard "natural" fabric, i.e. a fabric free of stretch yarns, that is typically about 10%.

The growth of the invention fabric (3.1) is less than half the value of the growth of the traditional fabric (7.8), thus confirming the excellent results obtainable from the invention yarn.

TABLE 1

| yarn count (NE) | spinning method | % strengh of yarn | % RKM cv | % ELN. | % ELN cv | % uniformity of the yarn | THIN % 40 | TICK % 35 | TICK % 50 | HAIRNESS | B-Force MIN. | B-Force MAX. | B-Force AVG. |
|---|---|---|---|---|---|---|---|---|---|---|---|---|---|
| 12 | C.PUN T400 + LYCRA | 15.5 | 5.8 | 9.8 | 6.3 | 9.3 | 5 | 297 | 26 | 9.2 | 660 | 833 | 750 |
| 12 | CORESPUN LYCRA | 16.8 | 6.1 | 9.1 | 6.1 | 9.8 | 20 | 370 | 36 | 7.7 | 694 | 920 | 810 |
| 10 | CORE-SPUN T400 | 14.1 | 8.0 | 7.7 | 6.1 | 8.6 | 1 | 199 | 12 | 9.9 | 700 | 978 | 815 |

TABLE 2

| | Weft | Spinning | fabric | dimensional stability in washing (BS 6330 2A, 3 cycle) | | weight g/m$^2$ | | width cm | |
|---|---|---|---|---|---|---|---|---|---|
| example | Ne | method | FNISH | welt (%) | warp (%) | unwashed | washed | unwashed | washed |
| 15170 | 12 | NEW YARN (core spun T400 + Lycra) | denim fnish | −5.0 | −3.5 | 356.0 | 380.0 | 153.0 | 145.6 |
| 93821 | 12 | CORE SPUN LYCRA | denim fnish | −8.5 | −6.5 | 340.0 | 377.0 | 157.0 | 148.0 |
| 3790 | 10 | CORE SPUN T400 | denim fnish | −3.5 | −4.0 | 399.0 | 421.0 | 146.5 | 141.5 |

| | elongation ASTM | tear strenght ASTM 1424 | | Tensile strenght ASTM 5034 | | stretch ASTM D3107 | trowth-ASTM D3107 |
|---|---|---|---|---|---|---|---|
| example | 3107 % | weft (gr) | warp (gr) | weft (kgf) | warp (kgf) | weft (%) | weft (%) |
| 15170 | 10.8 | 4279 | 7031 | 49.44 | 105.6 | 17.2 | 3.1 |
| 93821 | 11.2 | 4420 | 6784 | 45 | 100 | 18.7 | 7.8 |
| 3790 | 8.4 | 6303 | 7753 | 58.3 | 108 | 11.4 | 1.6 |

The invention claimed is:

1. A single yarn comprising:

a stretchable core; and an inelastic fiber sheath covering said core, wherein the stretchable core comprises first and second fibers each having elastic properties, said first fiber is an elastomer and said second fiber is selected from a polyester based (co)polymer and an elastomultiester, wherein the first and second fibers are twisted together and have at least 300 twists per meter and said first fiber has an elasticity and can be stretched of at least 400% and said second fiber has an elasticity less than said first fiber, said second fiber can be stretched of at least 20%, and wherein said first fiber is stretched before being bound together with said second fiber by co-extrusion.

2. The yarn according to claim 1, wherein the second fiber is in the range of 60-90% (w/w) of the stretchable core.

3. The yarn according to claim 1, wherein the inelastic fiber sheath completely covers said core and the stretchable core is drafted from 1.12 to 1.16 times its original length.

4. The yarn according to claim 1, wherein said second fiber is an elastomultiester bicomponent fiber and said first fiber is a polyolefin or a polyurethane elastomer.

5. The yarn according to claim 1, wherein said first fiber and second fiber are bound together so as to be stretched and to recover together as a single fiber.

6. The yarn according to claim 1, having an NE count within the range of 5 to 40, wherein the amount of core fibers is from 25 to 35% (w/w) of the total weight of the yarn and wherein the amount of the second fiber in the stretchable core, is within the range of 75% to 87% by weight and the inelastic fiber sheath completely covers said stretchable core.

7. The yarn according to claim 1, wherein said sheath fibers are cotton fibers, said first fiber is elastane and said second fiber is a PTT/PET bicomponent fiber.

8. A stretch fabric including the yarn according to claim 1.

9. A garment that contains the stretch fabric according to claim 8.

10. An apparatus for producing a stretch yam according to claim 1, comprising:

a frame for attaching a source of roving (8) and a source of a composite stretch core fibers (2), draft means for stretching said core fibers (2) with a draft ratio of the composite core (2) within the range of 1.05 to 1.16, and means for spinning said roving (8) around said core (2) to completely cover said core (2) with a sheath (3).

11. The apparatus according to claim 10, further comprising pre-tensioning means (10) for said stretch core (2).

12. The apparatus according to claim 10, further comprising guide means (15,16) for tensioning said roving (8).

13. The apparatus according to claim 11, wherein said pre-tensioning means for the said stretch core (2) comprise draft rollers (14) and a couple of rollers (11) supporting a rolling weight (12).

14. A stretch core (2) yarn, comprising first and second fibers (4, 5) that have elastic properties, said first fiber (4) is an elastomer and said second fiber (5) is a polyester based (co)polymer, said second fiber being in the range of 60-90% (w/w) of the stretchable core (2), and wherein said first and second fiber are connected together at least at a plurality of points, wherein said first fiber is stretched before being bound together with said second fiber by co-extrusion.

15. A stretch core yarn according to claim 14, wherein said first fiber is a polyurethane or a polyolefin elastomer, and said second fiber is a PTT/PET bicomponent fiber.

16. The yarn according to claim 1, wherein the second fiber has a higher recovery amount than the first fiber.

17. The yarn according to claim 7, wherein the NE count is within the range of 6 to 30.

18. The yarn according to claim 16, wherein said second fiber has a recovery property of at least 93%.

19. The yarn according to claim 16, wherein said second fiber has a recovery property of 96% or higher.

20. The yarn according to claim 14, wherein said second fiber has a higher recovery amount than the first fiber, wherein said second fiber has a recovery property of at least 93%.

21. The yarn according to claim 1, having an NE count within the range of 5 to 25, wherein the amount of core fibers is from 8 to 35% (w/w) of the total weight of the yarn.

22. The yarn according to claim 21, wherein the amount of core fibers is from 8 to 30% (w/w) of the total weight of the yarn.

23. The yarn according to claim 1, having an NE count within the range of 6 to 20, wherein, in a core of the yarn, the amount of core fibers is within the range of 8.9 to 29.7% (w/w/) of the total weight of the yarn.

24. The yarn according to claim 1, having an NE count within the range of 6 to 40, wherein a core ratio of the first fiber to the second fiber in deniers is 30/20, and the amount of core fibers is 3.5 to 23.6% (w/w) of the total weight of the yarn.

* * * * *